US005085623A

United States Patent [19]

Mitchard

[11] Patent Number: 5,085,623

[45] Date of Patent: Feb. 4, 1992

[54] BAR SCORING APPARATUS

[75] Inventor: John M. Mitchard, Cherry Hill, N.J.

[73] Assignee: Union Camp Corporation, Wayne, N.J.

[21] Appl. No.: 475,663

[22] Filed: Feb. 6, 1990

[51] Int. Cl.[5] ..... B31B 1/25; B65H 9/04; B65H 9/08

[52] U.S. Cl. ..... 493/400; 493/417; 271/245; 271/247; 271/250

[58] Field of Search ..... 493/396, 400, 417, 59, 493/60, 160, 161; 271/245, 247, 250, 251, 252

[56] References Cited

U.S. PATENT DOCUMENTS

| | | | |
|---|---|---|---|
| 1,723,414 | 8/1929 | Eggerss | 493/400 |
| 2,181,241 | 11/1939 | Klemm | 271/252 |
| 2,467,973 | 4/1949 | Gannon et al. | 493/396 |
| 2,592,246 | 4/1952 | Cloud | 493/417 |
| 2,996,961 | 8/1961 | Polayes | 493/396 |
| 3,308,723 | 3/1967 | Bergh | 493/354 |
| 3,566,755 | 3/1971 | Smith | 493/59 |
| 3,720,141 | 3/1973 | Stock | 493/342 |
| 4,603,572 | 8/1986 | Van Breukelen et al. | 72/385 |
| 4,767,393 | 8/1988 | Smith | 493/60 |

*Primary Examiner*—William E. Terrell
*Attorney, Agent, or Firm*—William K. Wissing

[57] ABSTRACT

Bar scoring apparatus with a conveyor for moving a corrugated box in one direction, a first conveyor table that is adapted to align the box and feed it to a scoring press in another direction, perpendicular to the one direction, and a second conveyor table that is adapted to receive the fully-scored box and feed it to a subsequent process in yet another direction, opposite to the one direction. The first conveyor table is inclined downwardly from the conveyor, and includes a datum edge to align the box under the influence of gravity. Once the box is fully-scored, a rotatable frame on the second conveyor table rotates downwardly to a horizontal position for offload of the box.

15 Claims, 7 Drawing Sheets

BAR SCORING APPARATUS

CROSS-REFERENCE TO RELATED APPLICATION

This application is related to a copending patent application, Ser. No. 272,088, filed Nov. 16, 1988, Pat. No. 4,946,540 entitled "Apparatus for the Manufacture of Laminated Bulk Boxes", assigned to the assignee of the present invention, and incorporated herein by reference.

BACKGROUND OF THE INVENTION

1. Field of the Invention

The invention described herein is generally related to improvements in a process for manufacturing a corrugated box, and more particularly to methods and apparatus used in scoring such corrugated boxes.

2. Statement of the Prior Art

"Scoring" is a process which is known in the art of boxmaking for its ability to make folds in a box. For example, a square or rectangular box requires four scores to make its four folded corners. A hexagonal-shaped box, on the other hand, requires six scores to make its six folded corners. In any case, it can be readily appreciated that the scores of a box must be parallel in order to provide an assembled box with straight sides. Scores that are not parallel to one another lead to misshapen, commercially undesirable products. It has, therefore, been an objective in box scoring apparatus of the prior art to provide boxes with accurately spaced, parallel scores.

Known bar scoring apparatus have typically employed multiple scoring presses to achieve such accuracy. However, such multi-bar scoring apparatus have suffered from two disadvantages. First, multi-bar scoring apparatus must employ a complex score bar mechanism for each desired score on a box. The maximum number of scores that can be applied to a box and the minimum spacing between adjacent scores is a function of the mechanical design of the score mechanisms and is therefore limited by the available space. In addition, the simultaneous application of the multiple bar scores, which is the normal procedure, does not permit the material between scores to yield and stretch, thereby frequently causing fractures to occur. Second, since the available force must be distributed over a variable number of scores, the unit pressure at each score will therefore vary accordingly, thus leading to variability in the end product. Variations in pressure most often exist from point to point along the box with multi-bar scoring apparatus. Accordingly, it would be desirable to provide bar scoring apparatus which do not suffer from these disadvantages.

One approach that has been utilized in the art of metal working to provide a number of successive parallel bend lines in corrugated metal plate is disclosed in U.S. Pat. No. 4,603,572. (VanBrenkelen et al.). With such apparatus, a corrugated metal plate is fed through a scoring press having a pair of opposed press beams which form a bend line accurately without deformation in the corrugated plate. After one bend line is made, the corrugated plate is incremented along a substantially horizontal feeder table to a position for the next bend line to be made. Complex mechanisms are required to maintain the corrugated metal plate in alignment. Therefore, it can be readily appreciated that the use of such apparatus to make multiple, successive, parallel folds in a box would unnecessarily complicate the manufacture of such boxes and increase the cost of such manufacture.

SUMMARY OF THE INVENTION

Accordingly, it is a general object of the present invention to provide improved bar scoring apparatus for the manufacture of corrugated boxes. More specifically, it is the object of this invention to provide a simple bar scoring apparatus for laminated bulk boxes that is capable of applying a plurality of parallel scores.

It is another object of the present invention to provide bar scoring apparatus that employs a single bar.

It is still another object of this invention to provide methods and apparatus for boxmaking that are capable of producing straight-sided boxes having any number of sides.

Briefly, these and other objects according to the present invention are accomplished with bar scoring apparatus comprising means for moving the box in one direction, a first conveyor table that is adapted to align the box and feed it to a scoring press in another direction, perpendicular to the one direction, and a second conveyor table that is adapted to receive the fully-scored box and feed it to a subsequent process in yet another direction, opposite to the one direction.

In accordance with one important aspect of the present invention, the first conveyor table is inclined downwardly from the moving means, and is provided with a datum edge along which a transverse leading edge of the box comes to rest under the influence of gravity, accurately aligned and prepared for the scoring press. Clamping means thereafter grasp the transverse leading edge and increment the box to a position beneath the scoring press at which a first fold line is to be applied. The scoring press is activated to apply such first fold line, and the box is incremented to its next position for application of a second and any subsequent fold lines. It can be readily appreciated, therefore, that any number of accurately-spaced parallel fold lines are capable of being applied by the bar scoring apparatus according to the present invention. Furthermore, the sides of such boxes can be made to be very narrow or very wide because each fold line can be carefully applied by the single bar scoring press as close together or as far apart from the next fold line as is necessary. The minimum width of a box side is merely a function of the width of the single bar used in the scoring press, and the tolerances of box movement which are possible with the clamping means used herein.

According to another important aspect of the present invention, the clamping means comprises a first clamping means attached to a first carriage means on the first conveyor table, and a second clamping means attached to a second carriage means on the second conveyor table. The first carriage means is adapted for movement in the other direction that is perpendicular to the direction of movement from which the box was received by the first conveyor table.

Three or more clamps of the first clamping means grasp the box by its aligned, transverse leading edge, and the box is moved to a position beneath the scoring press where its leading edge in the perpendicular direction of movement is grasped by three or more clamps of the second conveyor means. The clamps of the first clamping means release the transverse leading edge, and the box is then incremented to a position beneath the scoring press corresponding to the first fold line by the second carriage means. The scoring press applies the first fold line, and the second carriage means increments the box until all of its fold lines have been applied. Thereafter, the second carriage means draws the fully-scored box to a position entirely upon the second conveyor table and out from under the scoring press. The clamps of the second clamping means then releases the box and the second carriage means moves to a "home position" away from the box on the second conveyor table.

In accordance with yet another important aspect of the present invention, the fully-scored box is then removed from the second conveyor table by tilting such conveyor table and pulling the box off with a lug chain. That is, the process of applying a plurality of parallel scores on a corrugated box with apparatus according to the present invention is carried out with the second conveyor table and scoring press in a plane substantially the same as the inclined plane of the first conveyor table. The scoring press remains in such an inclined plane, but the second conveyor table is tilted downwardly to a substantially horizontal plane after the box has been fully-scored and the second carriage means is in its home position. Thereafter, the fully-scored box is drawn off the leveled second conveyor table by the lug chain while the second carriage means is returned to a position adjacent the scoring press, ready for the next box to be scored. In such a manner, a simple yet efficient bar scoring apparatus is provided.

The above, and other objects, advantages, uses, and novel features according to this invention will become more apparent to those of ordinary skill in the art of boxmaking from detailed descriptions of its preferred embodiment that follow, when considered in conjunction with an accompanying drawing wherein:

DETAILED DESCRIPTION OF THE PREFERRED EMBODIMENT

Figure 1:
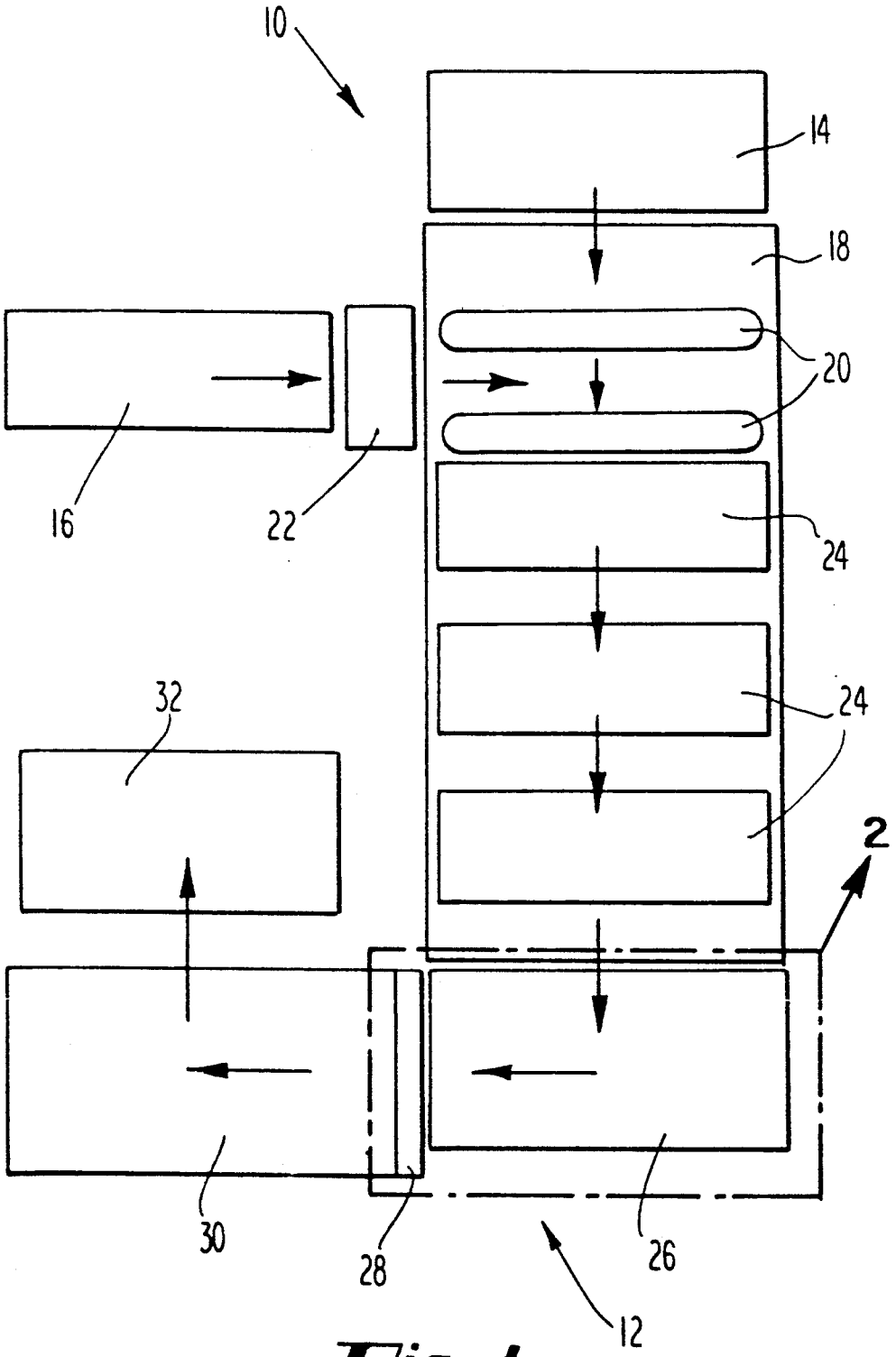
FIG. 1 is a block diagram of one suitable apparatus for the manufacture of laminated bulk boxes, which includes bar scoring apparatus according to the present invention.

Referring now to the drawings, wherein like element numbers designate similar or corresponding parts throughout each of the several views, there is shown in FIG. 1 a portion of a laminated bulk box machine 10 which utilizes bar scoring apparatus 12 according to the present invention.

A bulk box or bin as is well known, is a large container normally used for bulk shipment of flowable material, e.g., plastic resin, chemicals, powders, vegetables, etc., although other types of materials have been shipped in them. The range of capacities for this class of containers is 800–2200 pounds; the most common size is 1000 pounds.

The stacking strength needed for multi-tier storage with such bulk boxes is achieved by reinforcing the side walls of the container with additional plies of corrugated material. This approach optimizes the material used in the package design since the material in the bottom flaps or top flanges does not require reinforcement.

In order for the multiple layers of material in the construction of the box to be effective it is essential that the plies be tightly bonded to each other with adhesive. In addition, the inner reinforcement must be accurately placed relative to the outer blank to insure that, in the erected condition, the loading will be distributed equally to all parts. One suitable method and apparatus for achieving such bonding is disclosed in the above-mentioned application Ser. No. 272,088.

Bulk boxes vary in size and construction depending on the specific application. The corrugated material, i.e., flutes and basis weights of the constituent parts, are varied as well as the number of inner reinforcing plies or liners. The arrangement of the top flange/flaps and the bottom flaps of the box can be varied according to its particular design. While the most common box is a rectangular design there are others that have as many as eight sides. The outer blank can range in size from 43 to 96 square feet. A finished box can weigh as much as forty pounds. The size and weight of the component parts has resulted in the manufacturing process being very slow and frequently labor intensive.

The process of manufacturing bulk boxes involves assembling the inner liner(s) to the outer blank with adhesive. The blank/liner assembly is then compressed for a period of time to produce a strong bond between the elements. At the end of the compression cycle the blank/liner assembly is scored to define the corners of the box. The scores that define the top flange/flap and bottom flap are applied in a previous operation on the corrugator.

After the scoring operation the flat blank/liner assembly will be folded along two of the corner scores to form a tube. Adhesive is applied to one end of the flat blank/liner assembly so that when it is folded into the tube form, a joint can be made where the two ends meet. A compression step is employed at this point to set the joint bond.

Subsequent steps in the process involved delivering the completed box (in knocked-down tube form) to a stacking station where they are unitized to the customers specifications. Integral to this operation is the alternate rotation of boxes 180° to offset the joints in the stack to produce better stability in the finished unit.

A stack 14 of blank, corrugated sheets and a stack 16 of liners are first juxtaposed to a machine 18 for laminating the liners to the blanks. The detailed operation of machine 18 is not necessary for a complete understanding of the present invention but such operations are discussed fully in copending Ser. No. 272,088. Machine 18 includes powered roller conveyors 20 which position a blank to receive a liner which has already passed through a roll coater 22. Glue is applied to the liner as it passes through roll coater 22, and the liner is then accurately placed upon the positioned blank. After the blank and its liner have been so assembled, they are cycled upon the machine 18 through a plurality of compression pads 24. Uniform pressure is applied over the entire surface of the blank/liner assembly at each compression pad 24, in order to assure that a complete bond has been obtained. The blank/liner assembly is moved in the direction of the arrows on machine 18 by any suitable means such as a lug chain (not shown).

Once the box blank is so formed, it is moved by the lug chain to the bar scoring apparatus 12 according to the present invention. Bar scoring apparatus 12 as shown in FIG. 1 generally comprises a first conveyor means 26, a scoring press 28, and a second conveyor means 30. A plurality of parallel scores is applied to the box blank in bar scoring apparatus 12, and the box blank is moved on to further apparatus 32 which is not germane to the present application (e.g., apparatus for applying adhesive to the box joints, box folding, joint compression, etc.)

Figure 2:
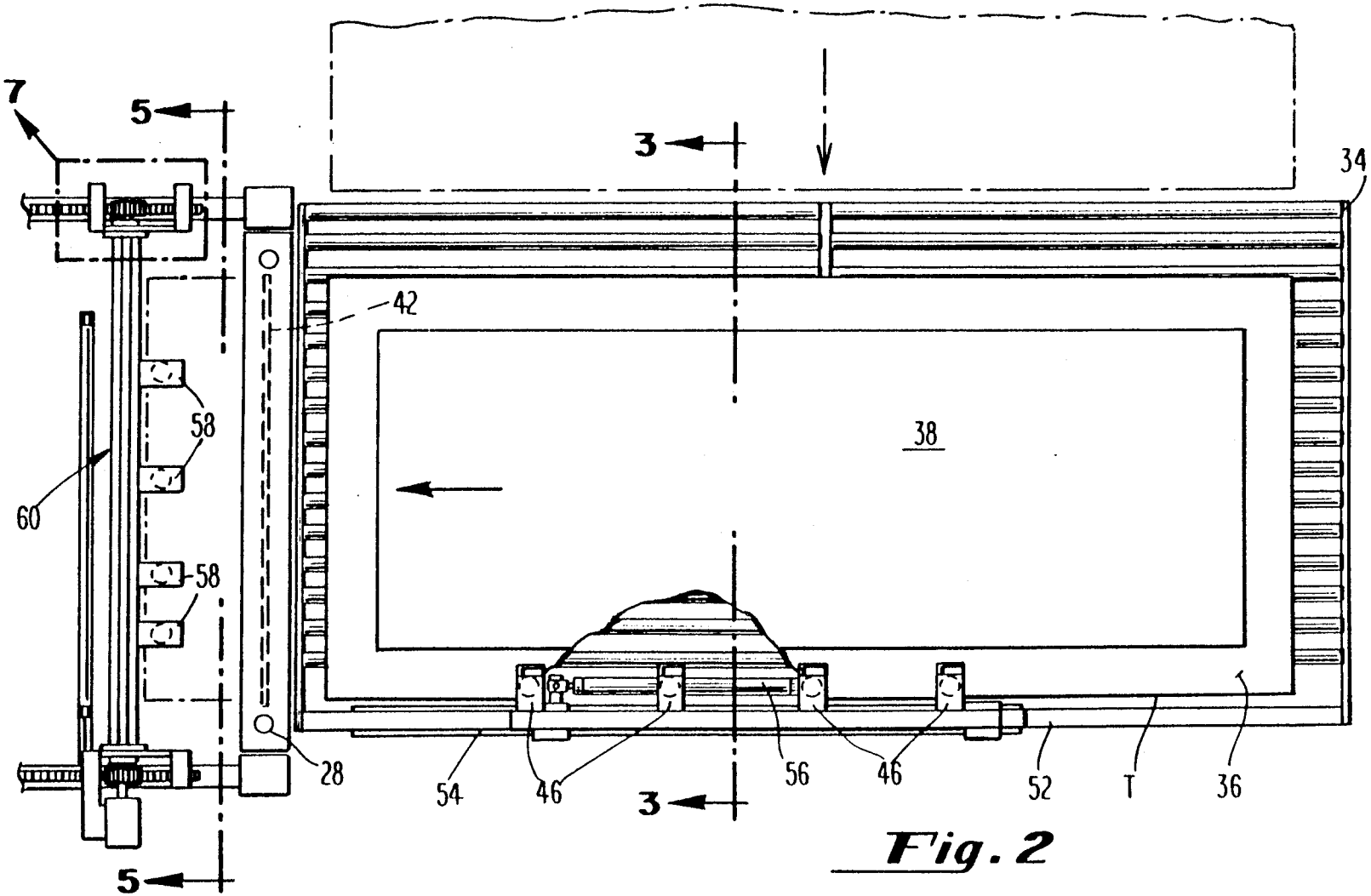
FIG. 2 is a plan view in greater detail showing the first conveyor means of FIG. 1.
Figure 3:
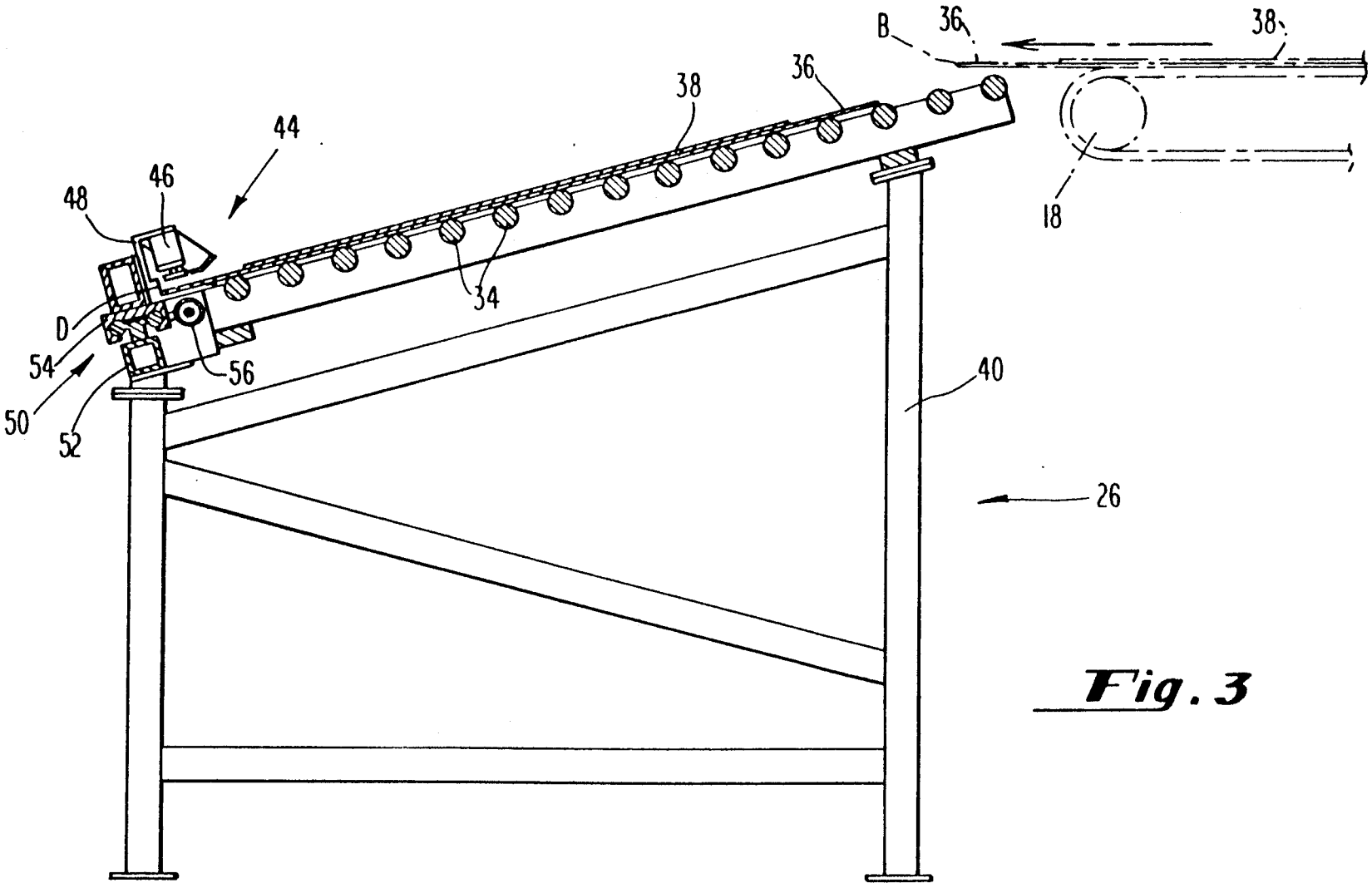
FIG. 3 is a section view, from lines 3—3 of FIG. 2, of the first conveyor means.

Referring now to FIG. 2, there is shown a plan view in greater detail of the first conveyor means 26 according to FIG. 1. Conveyor means 26 includes a plurality of rollers 34 that are disposed in a plane that is inclined downwardly from the substantially horizontal plane of machine 18. As shown more clearly in FIG. 3, a box blank hereinafter designed as box B (comprising blank 36 and liner 38) moving in the direction of the arrow from machine 18, is received upon the first conveyor means 26 and is conveyed under the influence of gravity to a fixed, datum edge D at a side of the conveyor table 40 opposite machine 18. Datum edge D thereby aligns a transverse leading edge T of the box blank, i.e., box B in a position ready for application of a plurality of parallel scores to provide fold lines of the box B. Rollers 34 may be of the gravity-type, or they may be powered rollers. In either case, however, transverse leading edge T of the box B is ensured to be properly aligned when it is in firm contact with datum edge D. Datum edge D is positioned perpendicular to the movement of the box B along machine 18, and more importantly perpendicular to a single bar 42 within scoring press 28. It has been found that an incline of from about 10° to about 30° is sufficient to convey the transverse leading edge T of box B to datum edge D. An angle of 15° incline has been found to be even more preferable for such purposes.

Once the box B is aligned, a first clamping means 44 on first conveyor means 26 is used to grasp the aligned box B. First clamping means 44 comprises three or more (preferably four) clamping members 46 which are adapted to firmly grasp the box B along the vicinity of its transverse leading edge T. Each clamping member 46 suitably comprises a pneumatically-operated cylinder and clamp face for firmly grasping the transverse leading edge T of the box B between a clamping frame 48 of substantially C-shape. The first clamping means 44 is attached for movement upon first carriage means 50 comprising a T-shaped rail 52 that is attached to conveyor table 40, a sliding member 54 coupled for movement upon the rail 52, and a pneumatic cylinder 56 that is attached both to the sliding member 54 and to the conveyor table 40. In such a manner, when a piston rod 58 within the cylinder 56 is extended, the sliding member 54 to which the distal end of the piston rod 48 is attached will move along rail 52 carrying with it the first clamping means 44 and box B grasped thereby. Cylinder 56 may alternatively comprise an hydraulic cylinder or any other suitable means for moving a laminated bulk box blank, e.g., box B.

Figure 4:
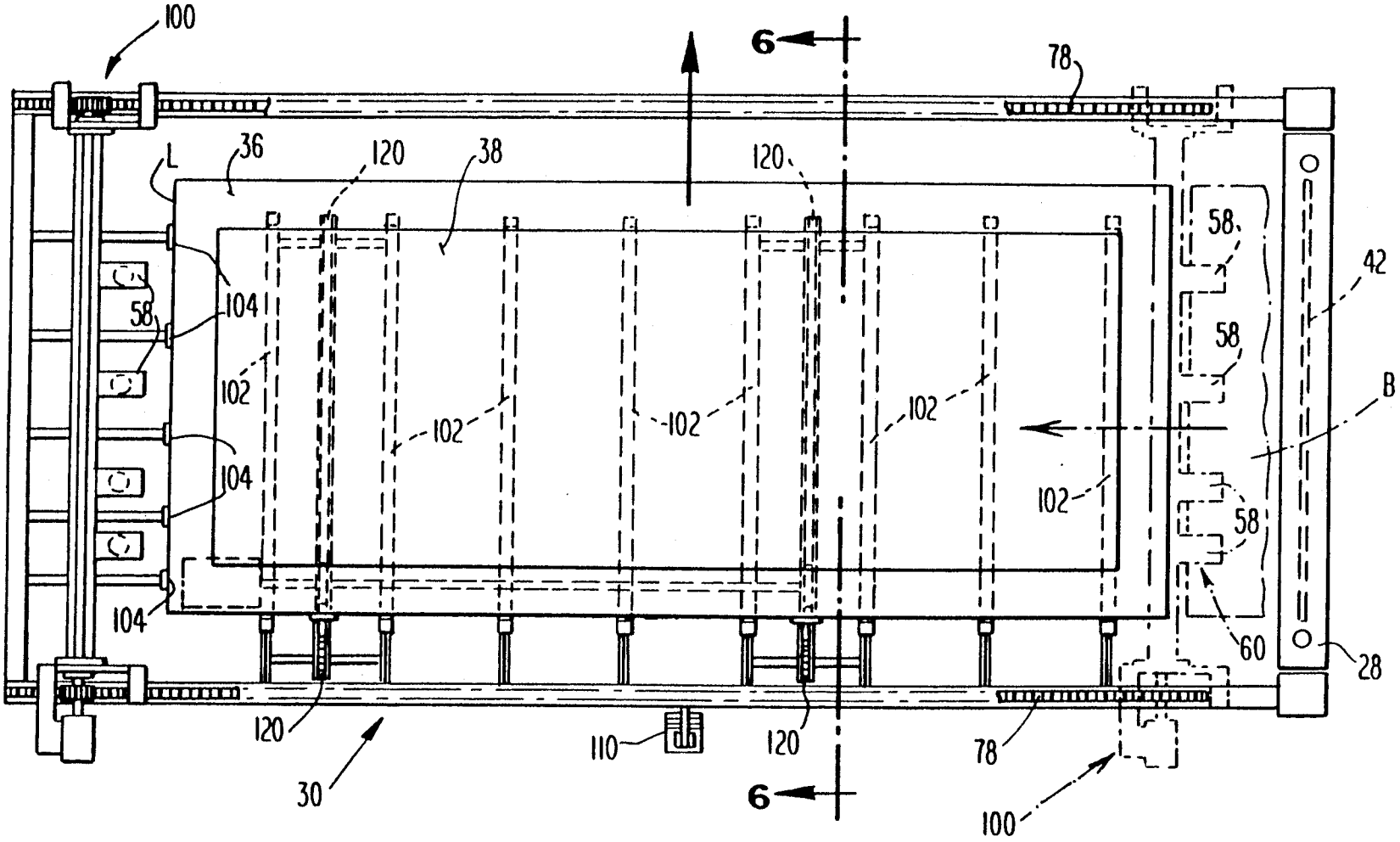
FIG. 4 is a plan view in greater detail showing the second conveyor means of FIG. 1.

It will be readily appreciated that any known means, such as a programmed computer, may be used for incrementing the movement of box B under the control of first clamping means 44. Accordingly, and referring now to FIGS. 2, 4 and 5, application of scores to the box B will now be explained.

Before the scoring press 28 is used to apply any scores, first clamping means 44 grasps the transverse leading edge T of box B while first carriage means 50 moves box B in a direction such that its width-wise leading edge L is maintained parallel to bar 42 of scoring press 28 to a fixed stop provided by a plurality of clamp members 58 attached to a second clamping means 60 (see, e.g., box B shown in phantom within clamp members 58 of FIG. 2). Clamp members 58 may be operated to open and close, thereby grasping a box blank, with any known means; however, servo-operated clamp members 58 are preferred in the bar scoring apparatus 12 according to the present invention.

Figure 7:
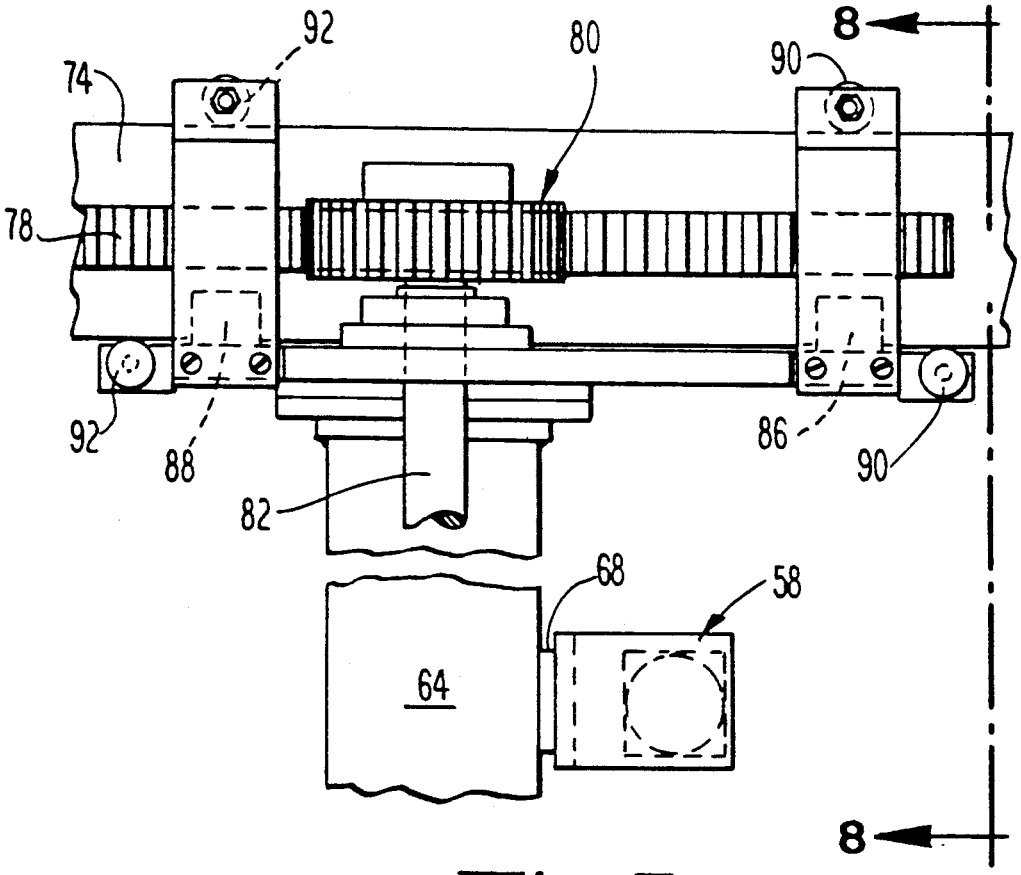
FIG. 7 is a plan view in greater detail showing the rack and pinion means of FIG. 2.
Figure 8:
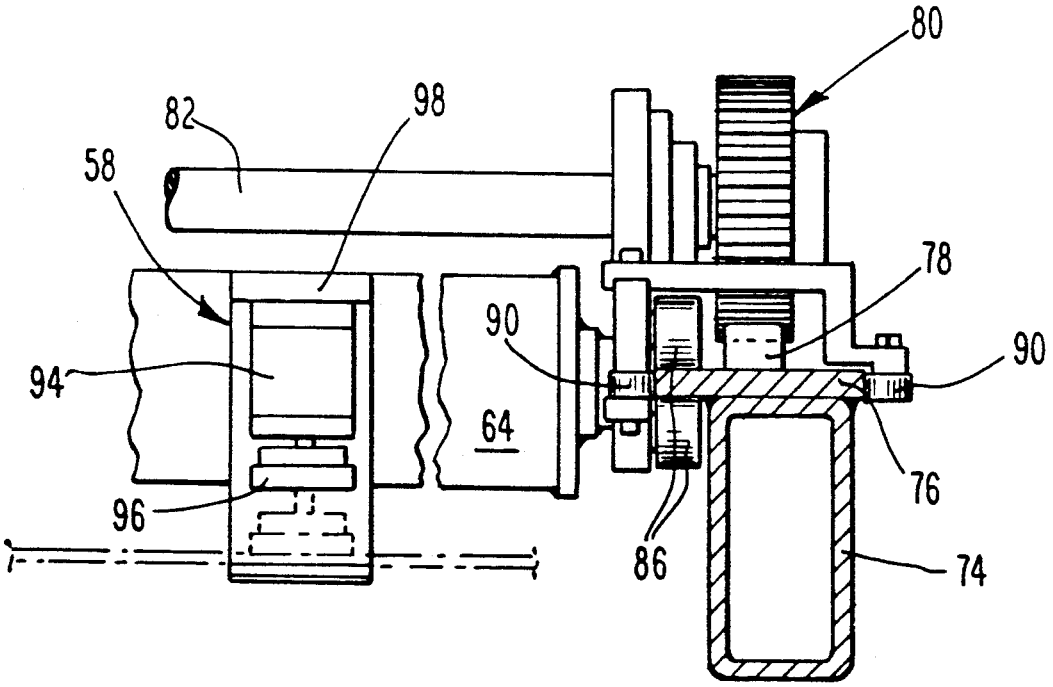
FIG. 8 is elevation view, from lines 8—8 of FIG. 7 of the rack and pinion means.

Once the clamp members 58 have grasped box B, the clamp members 46 of first clamping means 44 are released and the second clamping means 60 is used to position box B for application of its first fold line score. A second carriage means 62 is used for such purpose. Second carriage means 62 comprises support frame 64 for supporting clamp members 58, and motor means 66 for moving the box B across the second conveyor means 30. Referring more specifically for the moment to FIGS. 7 and 8 it can be seen that support frame 64 generally comprises a transverse member 68 to which each clamp member 58 is attached, and alignment means for maintaining the accuracy of the alignment of box B when it is upon the second conveyor means 30. Attached to the table portion 72 (FIG. 5) of second conveyor means 30 is a pair of rails 74. One of the rails 74 is disposed higher than the other, and a pair of mounting plates 76 welded thereto define a plane that is substantially the same as the inclined plane of first conveyor means 26. Track 78 is mounted upon each mounting plate 76, coupled to pinion means 80 that is driven by a common shaft 82 which is rotated by a motor 84. Motor 84 is controlled by the same means for incrementing the box B as are the clamp members 46, 58 and first carriage means 50. In order to maintain alignment of the box B on second conveyor means 30, a plurality of pairs of rollers 86, 88, 90 and 92 are provided to be coupled with the mounting plates 76. A first pair of rollers 86 coupled to support frame 64 maintain movement of the support frame 64 in a plane that is substantially parallel to the inclined surface of first conveyor means 26, while another pair 88 of such rollers may be used for the same purpose. A second pair of rollers 90 is also coupled on the sides of each mounting plate 76 to maintain movement of the support frame 64 substantially perpendicular to the datum edge D on first conveyor means 26, while a third pair of such rollers 92 are so coupled to ensure that the support frame 64 moves in a direction that is substantially parallel to the datum edge D. As is also seen in FIG. 8, each clamp member 58 generally comprises a pneumatically-operated piston 94 and a clamp face 96 situated within a C-shaped clamping frame 98. The above together comprises a second carriage means 100 for moving box B along second conveyor means 30.

Referring again more specifically to FIGS. 4 and 5, it can be seen that after the second clamp means 60 has grasped the leading edge L of box B and the first clamp means 44 has released the transverse leading edge T, second carriage means 100 will move the box B in the direction of the arrow shown in FIG. 4 across a plurality of rollers 102. The box B is incremented to a position adapted to dispose bar 42 of the scoring press 28 above a first fold line position. Thereafter, the scoring press 28 is activated to apply the first fold line score, second carriage means 100 moves the box B to its next position for application of another fold line score, the scoring press 28 is activated again, and so on. It can be readily appreciated that a plurality of parallel, accurately spaced fold lines may be quickly applied with the bar scoring apparatus 12 thus far described.

Figure 5:
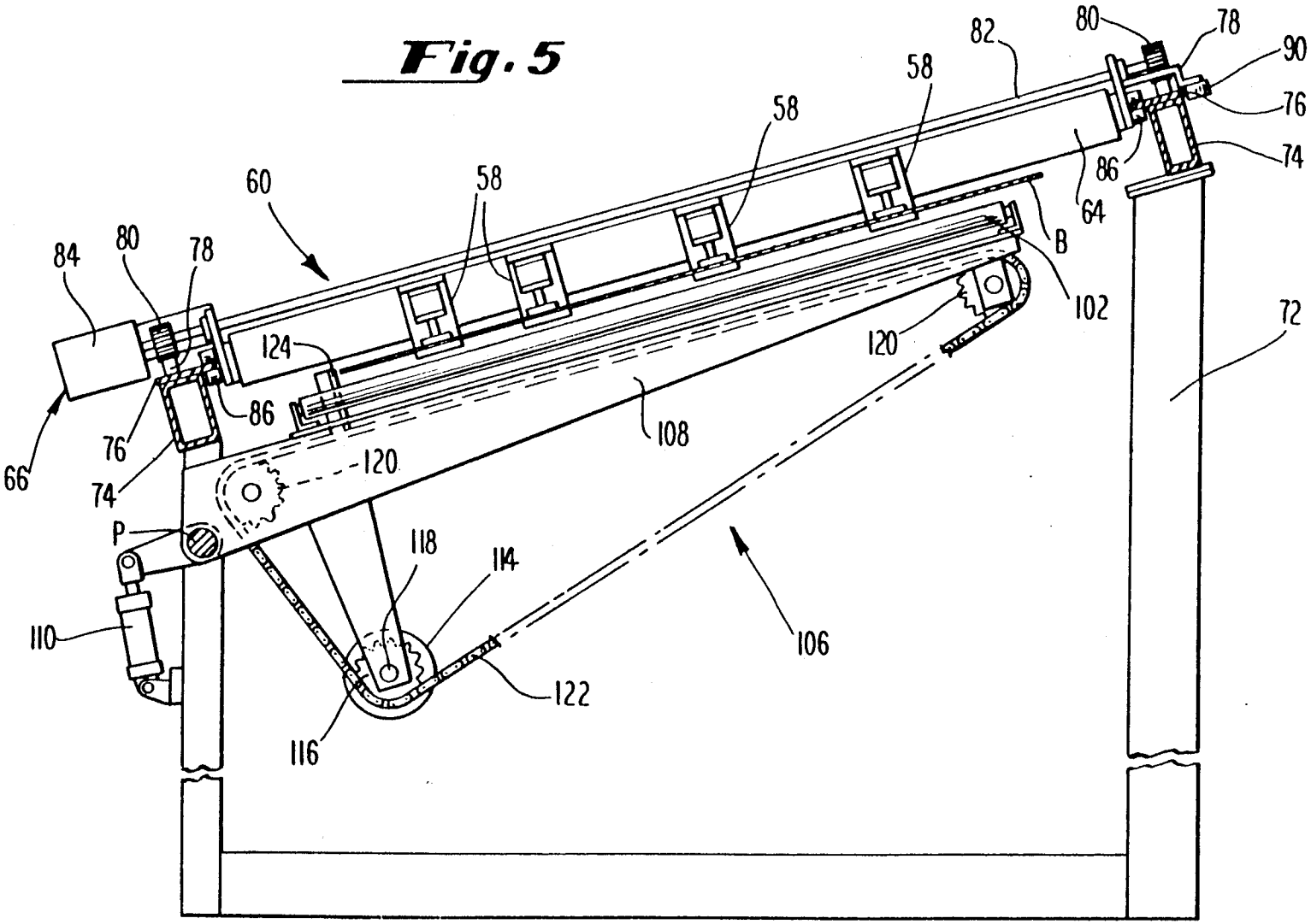
FIG. 5 is a section view, from lines 5—5 of FIG. 2, of the second conveyor means.
Figure 6:
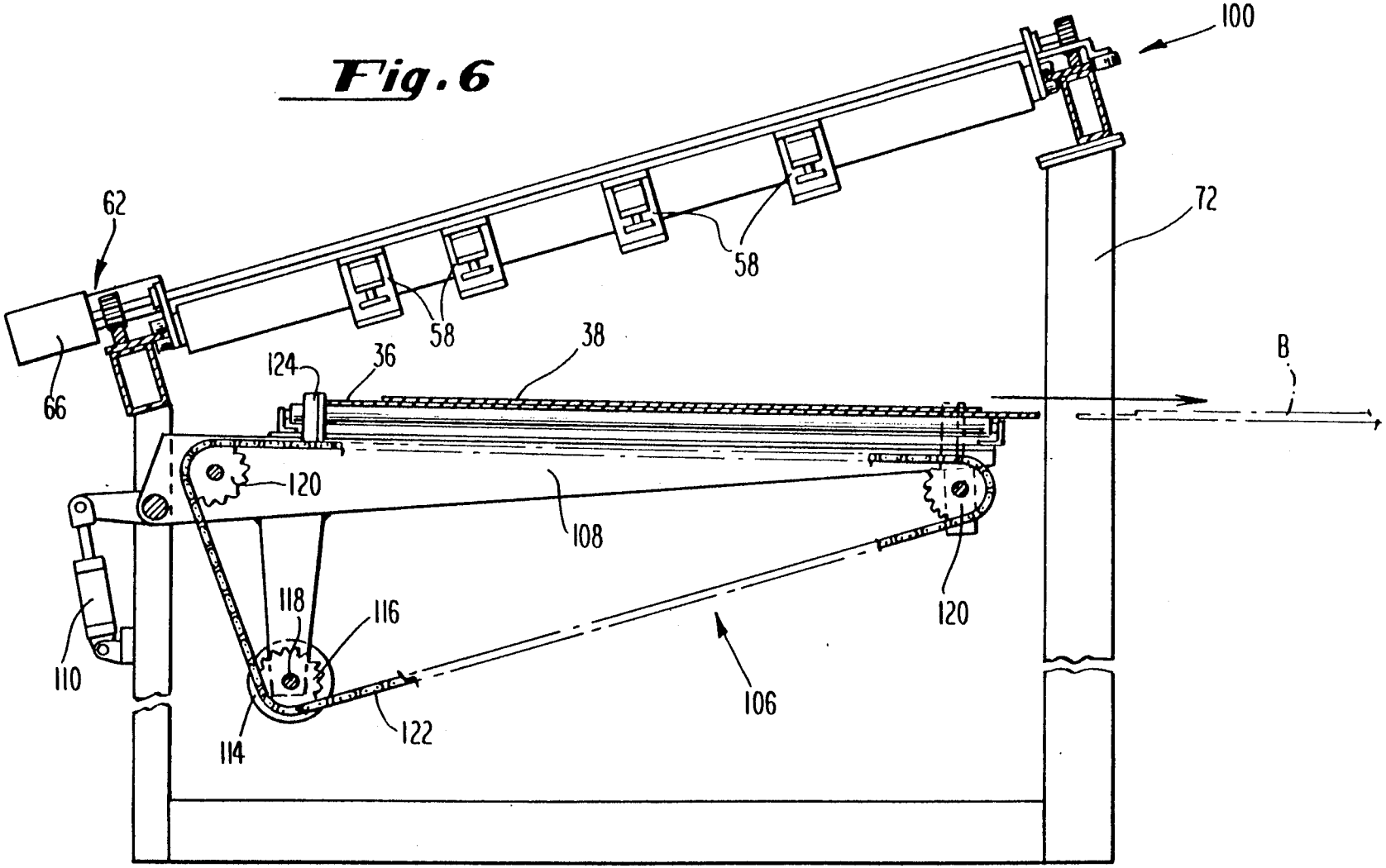
FIG. 6 is another view of the second conveyor means shown in FIG. 5 to illustrate the operations of such second conveyor means.

After the last fold line has been scored by scoring press 28, second carriage means 100 moves box B out from beneath scoring press 28 across the second conveyor means 30, supported by the plurality of rollers 102, and against a plurality of fixed stops 104 attached to the table portion 72. The clamp members 58 are then released, and the second carriage means 100 is moved to a "home position" as shown to the left of FIG. 4. As shown in FIG. 5, the rollers 102 are mounted in a movable plane upon a rotatable frame 106. Frame 106 generally comprises a pair of side frames 108 which are pivotable about point P, as rotated by extension and retraction of a cylinder 110. When cylinder 110 is in its retracted position as shown in FIG. 5, rotatable frame 106 and any box B thereon are substantially in the same plane as the inclined surface of first conveyor means 26. However, when cylinder 110 is in its extended position as shown in FIG. 6, the rotatable frame 106 is moved down through a predetermined angle and to a substantially horizontal position for offload of the box B.

In order to move the box B off of the second conveyor table 30, means such as a lug chain means are employed. Lug chain means includes motor means 114 for driving a pair of drive sprockets 120, a pair of chains 122 coupled to the drive sprockets 116 and idler sprockets 120, and a pair of lugs 124 attached to the chains 122. After the rotatable frame 106 is rotated to a horizontal position, motor means 114 is energized to rotate the chains 122 and pull the lugs 124 in the direction of the arrow shown in FIG. 6, thus pushing the fully-scored box B off of the second conveyor table 40. At the same time, second carriage means 100 is returned to a position adjacent scoring press 28, thereby speeding up operations. The rotatable frame 106 is then returned to an inclined position as shown in FIG. 5 ready to receive a new box B for scoring.

Obviously, many modifications and variations are possible in light of the above teachings. It should be understood, therefore, that within the scope of the appended claims the present invention may be practiced otherwise than as is specifically described herein.

I claim as my invention:

1. Apparatus for producing a scored box blank by applying a plurality of scores on a corrugated box blank having transverse edges and lateral edges, comprising:

means for moving the box blank in a first direction along a substantially horizontal plane;

first conveyor means for receiving the box blank from said horizontal plane, a transverse leading edge entering the first conveyor means, said first conveyor means including a plurality of rollers disposed in a plane that is inclined downwardly from said horizontal plane, said inclined plane having a first edge adjacent said horizontal plane and a second edge opposite said first edge;

first carriage means for moving the box blank in a second direction, perpendicular to said first direction, along said inclined plane, said first carriage means coupled for movement upon said first conveyor means;

first clamp means for grasping the box blank, said first clamp means connected to said first carriage means;

means for stopping the transverse leading edge of the box blank at said second edge, said stopping means adapted to align said transverse leading edge of the box blank, in a position perpendicular to said first direction;

second conveyor means adjacent said first conveyor means, said second conveyor means including a plurality of rollers disposed in a plane and attached to a frame that is movable through a predetermined arc;

a scoring press disposed between said first conveyor means and said second conveyor means substantially in said inclined plane;

second carriage means for moving the box blank in said second direction along said movable plane, said second carriage means coupled for movement upon said second conveyor means, said second carriage means further comprising means for incrementing the box blank along said inclined plane beneath said scoring press to said movable plane, said incrementing means including means for activating said scoring press to apply a score on the box blank at preselected points therealong; and second clamp means for grasping the box blank, said second clamp means connected to said second carriage means, whereby said frame is adapted to move through said predetermined arc after the box blank has been moved by said second carriage means entirely beneath said scoring press.

2. The apparatus according to claim 1, wherein said plurality of rollers of said first conveyor means comprises a plurality of powers rollers.

3. The apparatus according to claim 1, wherein said inclined plane comprises an angle of from about 10° to about 30° beneath said horizontal plane.

4. The apparatus according to claim 1, wherein said first clamp means comprises a plurality of clamping members each of which is disposed along said second edge.

5. The apparatus according to claim 4, wherein said plurality of clamping members comprises at least three clamping members.

6. The apparatus according to claim 5, wherein said plurality of clamping members comprises four clamping members.

7. The apparatus according to claim 1, further comprising means for delivering a scored box blank from said movable plane.

8. Laminated bulk box blank scoring apparatus, comprising:

a first conveyor table for receiving a laminated bulk box blank comprising an inclined surface;

means for aligning said box blank to a datum edge;

a scoring press for creating a score line in the box blank to create a scored blank, the score line disposed perpendicularly to said datum edge;

means for moving said box blank parallel to said datum edge beneath said scoring press comprising:

a first carriage having three or more clamping members spaced apart substantially along said lower edge; cylinder means for drawing said first carriage along said lower edge; a second carriage having three or more clamping members dispersed spaced apart along a line that is substantially parallel to said scoring press; and motor means for drawing said second carriage across said second conveyor table;

a second conveyor table, adjacent said first conveyor table, for receiving a scored box blank from said first conveyor table; and means for moving said second conveyor table from a first position to a second position to offload said scored box blank to a location outside said scoring apparatus.

9. The apparats according to claim 8, wherein said first conveyor table comprises:

a frame defining the inclined surface, wherein the surface is inclined beneath the horizontal, said surface having a higher edge and a lower edge; and a plurality of rollers extending across said inclined surface defined by said frame, extending substantially from said higher edge to said lower edge.

10. The apparatus according to claim 9, wherein said aligning means comprises a fixed stop disposed above said lower edge of said first conveyor table.

11. The apparatus according to claim 8, wherein said second carriage comprises;

a pair of rails each of which is fixedly aligned to a respective one of said higher and lower edges;

a rack attached to an upper surface of each said rail;

a shaft, coupled to be driven by said motor means, and extending across said second conveyor table substantially perpendicular to said rails;

pinion means, mounted upon said shaft, for coupling with each said rack;

frame means for supporting said shaft and said three or more clamping members, whereby said frame means is adapted to be moved above said second conveyor table by said motor means driving said pinion means; and means for guiding said frame means along said rails to ensure its movement in a direction that is substantially parallel to said datum edge.

12. The apparatus according to claim 11, wherein said guide means comprises:

a first pair of rollers coupled to each said rail, and adapted to maintain movement of said frame means in a plane that is substantially parallel to said inclined surface; and a second pair of rollers coupled to each said rack, and adapted to maintain said frame means substantially perpendicular to said datum edge.

13. The apparatus according to claim 12, wherein said guide means further comprises a third pair of rollers coupled to each said rack, and adapted to ensure said frame means moves in a direction that is substantially parallel to said datum edge.

14. In apparatus for manufacturing a bulk box, including means for moving the box blank along a substantially horizontal surface in a first direction, the improvement comprising:

a first conveyor table adjacent to the moving means wherein a surface of the first conveyor table is disposed in a plane that is inclined downwardly from the moving means, said inclined plane disposed at an angle to the horizontal chosen to permit the first conveyor table to receive a transverse leading edge of the box blank that is transferred solely by the influence of gravity;

a second conveyor table adjacent said first conveyor table said first conveyor table conveying the box blank to said second said first conveyor table, said second conveyor table disposed in said inclined plane while receiving the box blank and further comprising rotatable frame means for moving the second conveyor table to another plane for delivering the box blank to a further location in a different orientation than in which it is received by said second conveyor table; and a scoring press for scoring the box blanks disposed between said first and second conveyor tables.

15. A method for applying a plurality of scores on a corrugated box blank, comprising:

moving the box blank in a first direction along a conveyor means defining a substantially horizontal plane;

receiving the box blank from said horizontal plane in a conveyor means defining a plane that is inclined downwardly from said horizontal plane, said conveyor means defining an inclined plane having a first edge adjacent said horizontal plane and a second edge opposite said first edge;

moving the box blank in a second direction, transverse to said first direction, along said inclined plane;

stopping a transverse leading edge of the box blank at said second edge to align said transverse leading edge of the box blank in a position perpendicular to said first direction;

moving the box blank in said second direction along a rotatable frame means defining a movable plane;

incrementally feeding the box blank along said inclined plane beneath a scoring press to said movable plane;

activating said scoring press to apply a score on the box blank at preselected points therealong concurrent with the step of incrementally feeding the box blank; and moving said rotatable frame means defining a movable plane through a predetermined arc after the box blank has been moved entirely beneath said scoring press.

* * * * *